US009991043B2

(12) United States Patent
Andres et al.

(10) Patent No.: US 9,991,043 B2
(45) Date of Patent: Jun. 5, 2018

(54) INTEGRATED MAGNETIC ASSEMBLIES AND METHODS OF ASSEMBLING SAME

(71) Applicant: General Electric Company, Schenectady, NY (US)

(72) Inventors: Joao Luiz Andres, Murphy, TX (US); Jouni Timo Uusitalo, Rockwall, TX (US); Arturo Silva, Allen, TX (US)

(73) Assignee: General Electric Company, Schenectady, NY (US)

( * ) Notice: Subject to any disclaimer, the term of this patent is extended or adjusted under 35 U.S.C. 154(b) by 95 days.

(21) Appl. No.: 14/206,560

(22) Filed: Mar. 12, 2014

(65) Prior Publication Data

US 2014/0266530 A1 Sep. 18, 2014

Related U.S. Application Data

(60) Provisional application No. 61/792,574, filed on Mar. 15, 2013.

(51) Int. Cl.
*H01F 27/28* (2006.01)
*H01F 27/30* (2006.01)
(Continued)

(52) U.S. Cl.
CPC ..... *H01F 27/29* (2013.01); *H01F 3/14* (2013.01); *H01F 27/2852* (2013.01);
(Continued)

(58) Field of Classification Search
CPC ..... H01F 5/00; H01F 27/28
(Continued)

(56) References Cited

U.S. PATENT DOCUMENTS 3,414,797 A 12/1968 Morgan
3,553,620 A 1/1971 Cielo et al.
(Continued)

FOREIGN PATENT DOCUMENTS

GB 2068648 A 8/1981
JP 2001297924 A * 10/2001
(Continued)

OTHER PUBLICATIONS

International Search Report and Written Opinion issued in connection with corresponding PCT Application No. PCT/US2014/025490 dated Jun. 16, 2014.

*Primary Examiner* — Tsz Chan
(74) *Attorney, Agent, or Firm* — General Electric Company

(57) ABSTRACT

An integrated magnetic assembly includes a magnetic core, an input winding inductively coupled to the magnetic core, a first output winding inductively coupled to the magnetic core, and a second output winding inductively coupled to the magnetic core. The magnetic core includes first and second non-winding legs, and first and second winding legs. The first and second non-winding legs are spaced apart from one another, and the magnetic core defines an opening between the first and second non-winding legs. The input winding extends through the opening between the first and second non-winding legs, and is wound around each of the first and second winding legs. The first output winding is wound around the first winding leg. The second output winding is wound around the second winding leg.

20 Claims, 11 Drawing Sheets

(51) Int. Cl.

| | |
|---|---|
| ***H01F 27/24*** | (2006.01) |
| ***H01F 17/04*** | (2006.01) |
| ***H01F 27/29*** | (2006.01) |
| ***H01F 3/14*** | (2006.01) |
| ***H01F 27/32*** | (2006.01) |

(52) U.S. Cl.
CPC ..... *H01F 27/306* (2013.01); *H01F 27/323* (2013.01); *Y10T 29/49073* (2015.01)

(58) Field of Classification Search
USPC ..... 336/170, 178, 180, 182, 183, 196, 198, 336/200, 212, 219, 221, 232
See application file for complete search history.

(56) References Cited

U.S. PATENT DOCUMENTS

| | | | | |
|---|---|---|---|---|
| 4,853,668 | A | 8/1989 | Bloom | |
| 4,864,478 | A | 9/1989 | Bloom | |
| 5,555,494 | A | 9/1996 | Morris | |
| 5,559,487 | A * | 9/1996 | Butcher | H01F 27/324 336/178 |
| 5,790,005 | A | 8/1998 | Santi et al. | |
| 7,034,647 | B2 | 4/2006 | Yan et al. | |
| 7,298,118 | B2 | 11/2007 | Chandrasekaran | |
| 7,876,191 | B2 | 1/2011 | Chandrasekaran et al. | |
| 7,915,989 | B2 * | 3/2011 | Li | H01F 3/10 336/170 |
| 8,040,704 | B2 | 10/2011 | Cuk | |
| 8,081,493 | B2 | 12/2011 | Lund et al. | |
| 8,134,443 | B2 | 3/2012 | Chandrasekaran et al. | |
| 2005/0007230 | A1 | 1/2005 | Fushimi | |
| 2005/0024179 | A1 | 2/2005 | Chandrasekaran et al. | |
| 2005/0068149 | A1 | 3/2005 | Fushimi | |
| 2006/0097837 | A1 | 5/2006 | Yamasaki et al. | |
| 2009/0289751 | A1 | 11/2009 | Nagano et al. | |
| 2010/0117780 | A1 * | 5/2010 | Hsieh | H01F 27/2852 336/222 |
| 2010/0321958 | A1 * | 12/2010 | Brinlee | H02M 3/28 363/21.1 |

FOREIGN PATENT DOCUMENTS

| | | | |
|---|---|---|---|
| JP | 2002057045 | A * | 2/2002 |
| JP | 2004297862 | A * | 10/2004 |
| JP | 2005108963 | A * | 4/2005 |
| JP | 2010050160 | A * | 3/2010 |
| JP | 2011103365 | A * | 5/2011 |
| KR | 20110123083 | A * | 11/2011 |

* cited by examiner

INTEGRATED MAGNETIC ASSEMBLIES AND METHODS OF ASSEMBLING SAME

CROSS-REFERENCE TO RELATED APPLICATIONS

This application claims the benefit of U.S. Provisional Patent Application No. 61/792,574 filed Mar. 15, 2013, which is hereby incorporated by reference in its entirety.

BACKGROUND

The field of the invention relates generally to power electronics, and more particularly, to integrated magnetic assemblies for use in power electronics.

High density power electronic circuits often require the use of multiple magnetic electrical components for a variety of purposes, including energy storage, signal isolation, signal filtering, energy transfer, and power splitting. As the demand for higher power density electrical components increases, it becomes more desirable to integrate two or more magnetic electrical components, such as transformers and inductors, into the same core or structure.

However, in known integrated magnetic assemblies, the magnetic flux produced by one component may not result in a zero net effect on the operation of the other component(s) in the integrated structure. As a result, the effectiveness and/or the efficiency of the integrated components may be reduced.

Additionally, in at least some known integrated magnetic assemblies, fringing flux has several detrimental effects on the operation of the integrated magnetic assembly. Fringing flux is a component of a magnetic flux that deviates from a main magnetic flux path. Fringing flux often passes through other, non-active components in an electronic circuit, inducing eddy currents in the windings of such components. This results in increased power losses in the windings and reduced efficiency. In addition, fringing flux reduces the inductance of integrated magnetic assemblies. Thus, when such integrated magnetic assemblies are used in power converters, fringing flux increases the amplitude of ripple current, leading to higher power losses and poor efficiency.

BRIEF DESCRIPTION

In one aspect, an integrated magnetic assembly is provided. The integrated magnetic assembly includes a magnetic core, an input winding inductively coupled to the magnetic core, a first output winding inductively coupled to the magnetic core, and a second output winding inductively coupled to the magnetic core. The magnetic core includes first and second non-winding legs, and first and second winding legs. The first and second non-winding legs are spaced apart from one another, and the magnetic core defines an opening between the first and second non-winding legs. The input winding extends through the opening between the first and second non-winding legs, and is wound around each of the first and second winding legs. The first output winding is wound around the first winding leg. The second output winding is wound around the second winding leg.

In another aspect, a method of assembling an integrated magnetic assembly is provided. The method includes providing a magnetic core including first and second non-winding legs, and first and second winding legs, where the first and second non-winding legs are spaced apart from one another, and the magnetic core defines an opening between the first and second non-winding legs, providing an input winding, providing a first output winding, providing a second output winding, inductively coupling the input winding to the magnetic core such that the input winding extends through the opening between the first and second non-winding legs and is wound around each of the first and second winding legs, inductively coupling the first output winding to the magnetic core such that the first output winding is wound around the first winding leg, and inductively coupling the second output winding to the magnetic core such that the second output winding is wound around the second winding leg.

In yet another aspect an integrated magnetic core is provided. The integrated magnetic core includes a first plate, a second plate, first and second non-winding legs extending between the first plate and the second plate, and first and second winding legs extending between the first plate and the second plate. The first and second non-winding legs are spaced apart from one another, and the first plate, the second plate, the first non-winding leg, and the second non-winding leg define an opening between the first and second non-winding legs.

Although specific features of various embodiments may be shown in some drawings and not in others, this is for convenience only. Any feature of any drawing may be referenced and/or claimed in combination with any feature of any other drawing.

DETAILED DESCRIPTION

Example embodiments of integrated magnetic assemblies are described herein. An integrated magnetic assembly includes a magnetic core, an input winding inductively coupled to the magnetic core, a first output winding inductively coupled to the magnetic core, and a second output winding inductively coupled to the magnetic core. The magnetic core includes first and second non-winding legs, and first and second winding legs. The first and second non-winding legs are spaced apart from one another, and the magnetic core defines an opening between the first and second non-winding legs. The input winding extends through the opening between the first and second non-winding legs, and is wound around each of the first and second winding legs. The first output winding is wound around the first winding leg. The second output winding is wound around the second winding leg.

Figure 1:
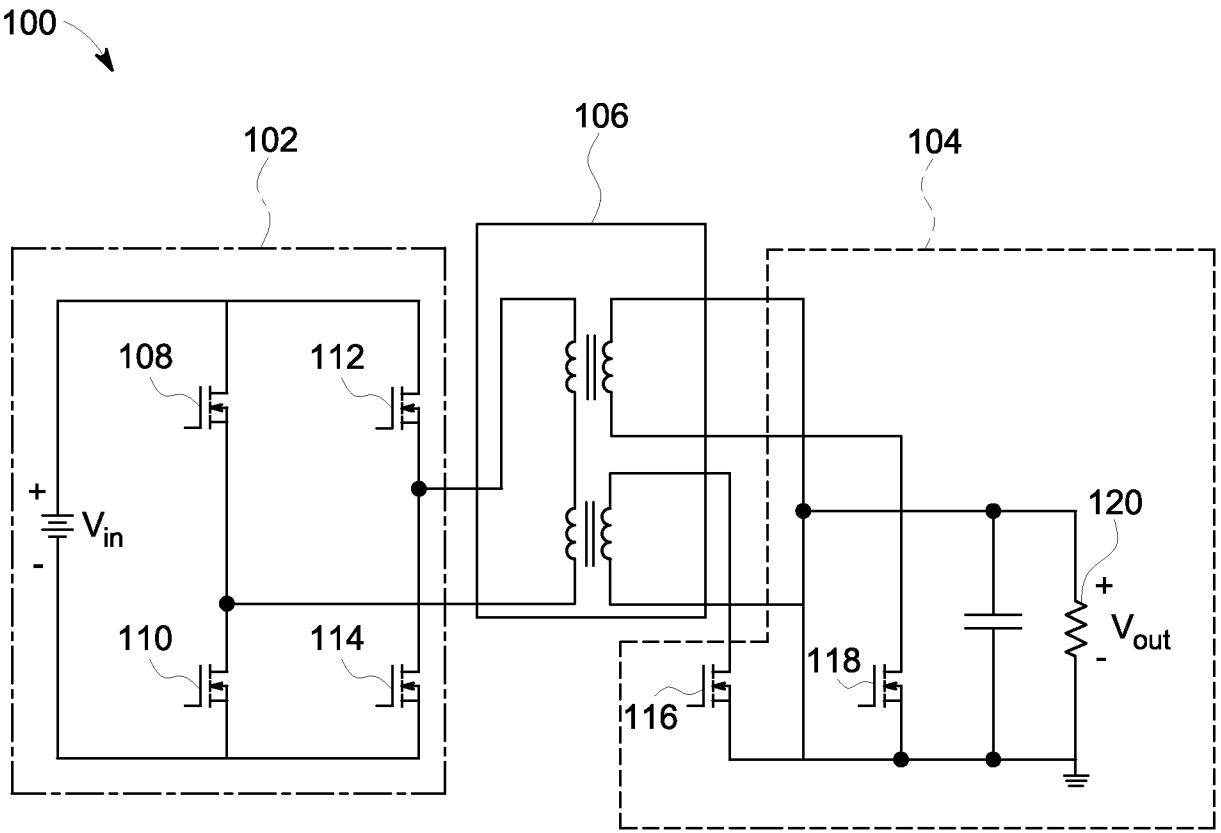
FIG. 1 is a schematic view of an example power converter including an integrated magnetic assembly.

FIG. 1 is a schematic view of an example electronic circuit, shown in the form of a power converter 100 configured to convert an input voltage $V_{in}$ to an output voltage $V_{out}$. Power converter 100 includes an input side 102 and an output side 104 electrically coupled to one another via an integrated magnetic assembly 106.

Input side 102 includes a first switching device 108, a second switching device 110, a third switching device 112, and a fourth switching device 114. As described in more detail herein, terminal ends of an input winding of integrated magnetic assembly 106 are electrically coupled between first switching device 108 and second switching device 110, and between third switching device 112 and fourth switching device 114.

Output side 104 includes a fifth switching device 116 and a sixth switching device 118. As described in more detail herein, terminal ends of first and second output windings of integrated magnetic assembly 106 are electrically coupled to fifth switching device 116 and sixth switching device 118, respectively.

In operation, first switching device 108 and fourth switching device 114 are jointly switched between opened and closed positions, and second switching device 110 and third switching device 112 are jointly switched between opened and closed positions in opposite phases with respect to first switching device 108 and fourth switching device 114. Similarly, fifth switching device 116 and sixth switching device 118 are switched between opened and closed positions in opposite phases to produce output voltage $V_{out}$, which is supplied to a load 120. In the example embodiment, switching devices 108, 110, 112, 114, 116, and 118 are illustrated as transistor switches (specifically, MOSFETs), and are coupled to one or more controllers (not shown) configured to output a pulse-width modulated control signal to the gate side of each switching device 108, 110, 112, 114, 116, and 118 to switch the switching devices between open and closed positions.

While integrated magnetic assembly 106 is described herein with reference to power converter 100, integrated magnetic assembly 106 may be implemented in any suitable electrical architecture that enables integrated magnetic assembly 106 to function as described herein, including, for example, fly back converters, forward converters, and push-pull converters.

Figure 2:
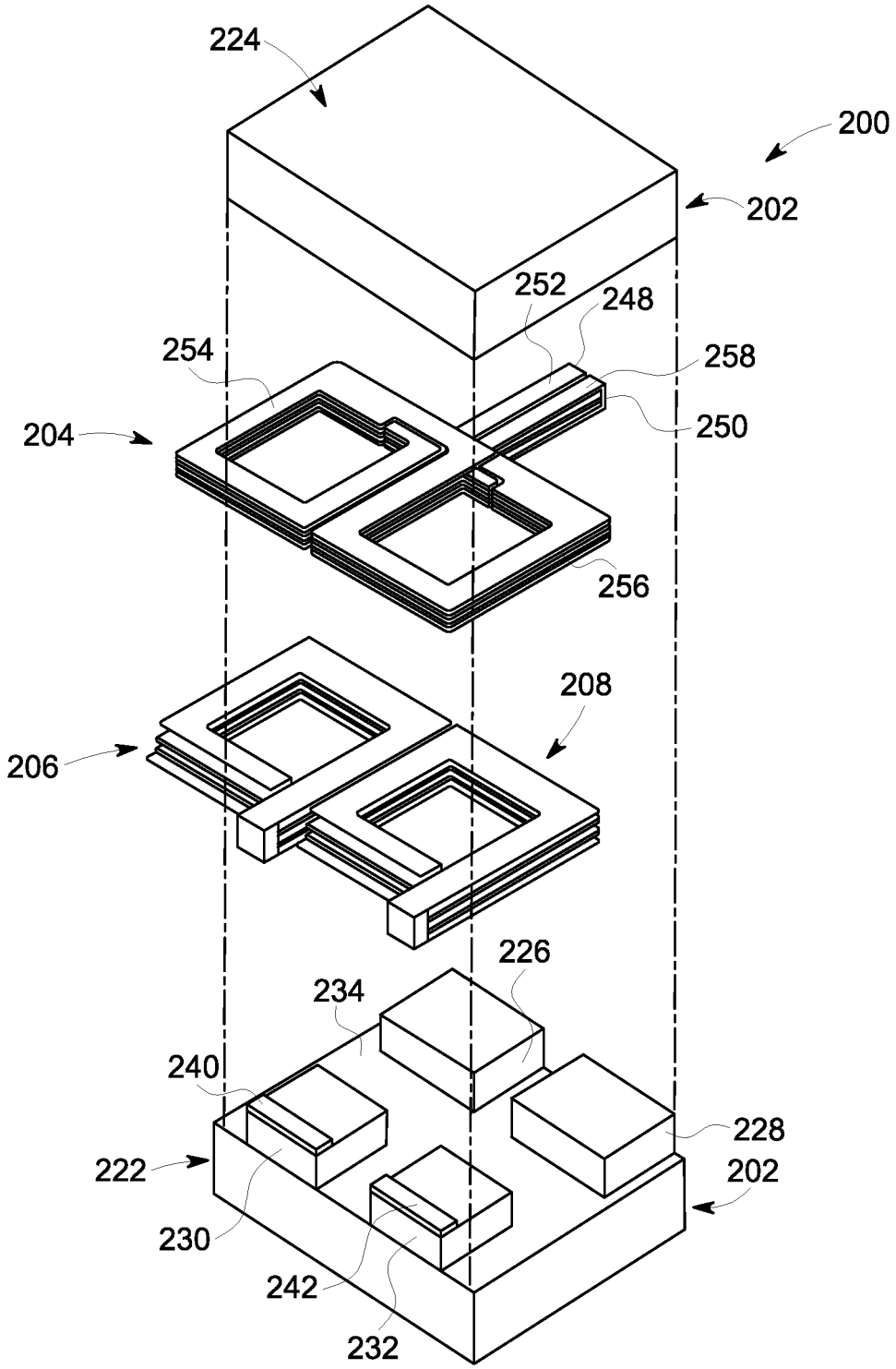
FIG. 2 is an exploded view of an example integrated magnetic assembly suitable for use in the power converter shown in FIG. 1.

FIG. 2 is an exploded view of an example integrated magnetic assembly 200 suitable for use in power converter 100. Integrated magnetic assembly 200 includes a magnetic core 202, an input winding 204, a first output winding 206, and a second output winding 208. Input winding 204, first output winding 206, and second output winding 208 are inductively coupled to magnetic core 202 such that multiple transformers and inductors are formed within integrated magnetic assembly 200.

Figure 3:
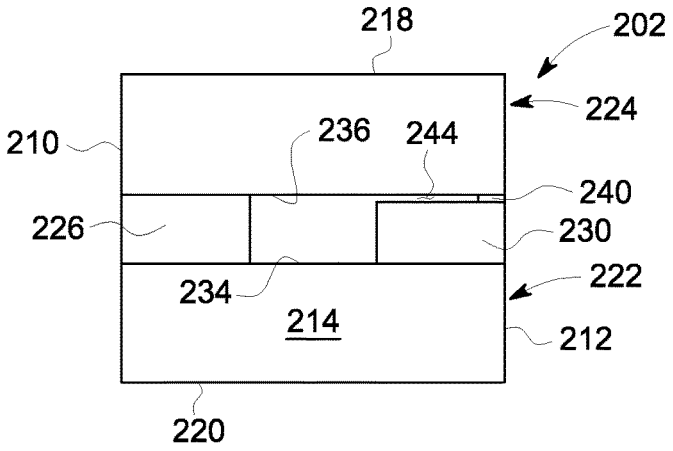
FIG. 3 is an end view of the magnetic core of the integrated magnetic assembly shown in FIG. 2.
Figure 4:
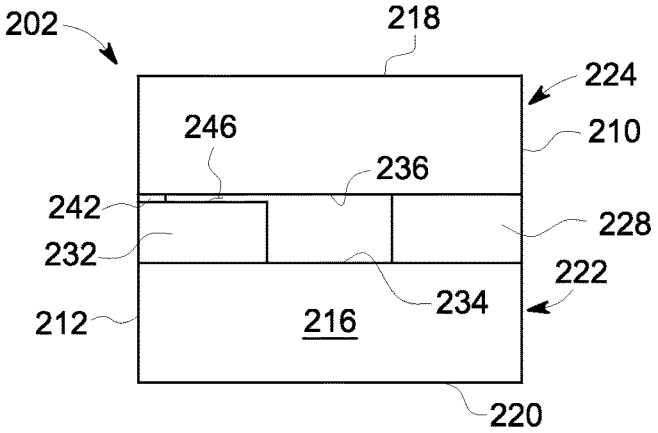
FIG. 4 is another end view of the magnetic core of the integrated magnetic assembly shown in FIG. 2.
Figure 5:
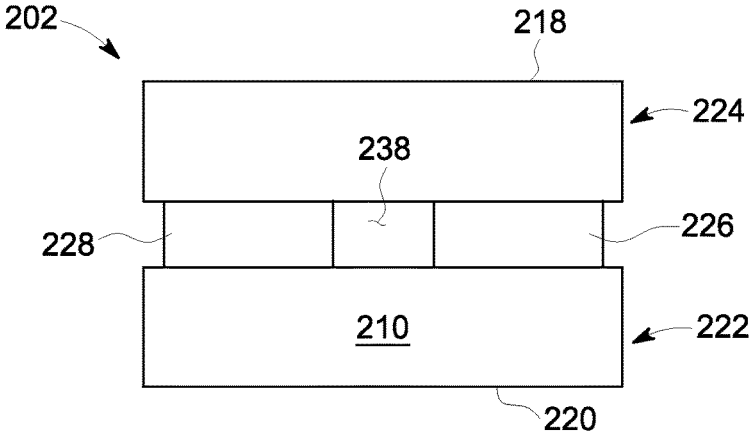
FIG. 5 is a side view of the magnetic core of the integrated magnetic assembly shown in FIG. 2.

FIG. 3 is an end view of magnetic core 202, FIG. 4 is another end view of magnetic core 202, and FIG. 5 is a side view of magnetic core 202. As shown in FIGS. 2-5, in the example embodiment, magnetic core 202 has a generally rectangular shape including six sides. The six sides of magnetic core 202 include a first side 210, an opposing second side 212, first and second opposing ends 214 and 216 extending between first side 210 and second side 212, and a top 218 and an opposing bottom 220 extending between first side 210 and second side 212 and between first end 214 and second end 216. In alternative embodiments, magnetic core 202 may have any suitable shape and any suitable number of sides that enables integrated magnetic assembly 200 to function as described herein.

In the example embodiment, magnetic core 202 includes a first plate 222, a second plate 224, first and second non-winding legs 226 and 228 extending between first plate 222 and second plate 224, and first and second winding legs 230 and 232 extending between first plate 222 and second plate 224. As used herein, the term "winding leg" refers to a leg of magnetic core 202 around which at least one of input winding 204, first output winding 206, and second output winding 208 are wound. As used herein, the term "non-winding leg" refers to the legs of magnetic core 202 which are not winding legs.

As shown in FIGS. 3-5, in the example embodiment, first plate 222 is coupled to second plate 224 via first and second non-winding legs 226 and 228. In other suitable embodiments, first plate 222 may be coupled to second plate 224 via one or both of first winding leg 230 and second winding leg 232. First plate 222 and second plate 224 each include a respective interior surface 234 and 236 between which winding legs 230 and 232 and non-winding legs 226 and 228 extend. When integrated magnetic assembly 200 is assembled (shown in FIGS. 3-5), interior surfaces 234 and 236 are in facing relationship with one another. In the example embodiment, each winding leg 230 and 232 and non-winding leg 226 and 228 extends from interior surface 234 of first plate 222 towards interior surface 236 of second plate 224. In other suitable embodiments, one or more of winding legs 230 and 232 and non-winding legs 226 and 228 may extend from interior surface 236 of second plate 224 towards interior surface 234 of first plate 222.

First winding leg 230 and second winding leg 232 are spaced apart from one another a sufficient distance to receive one or more segments of input winding 204, first output winding 206, and second output winding 208 therebetween. Further, first winding leg 230 is spaced apart from first non-winding leg 226 a sufficient distance to receive one or more segments of input winding 204, first output winding 206, and second output winding 208 therebetween, and second winding leg 232 is spaced apart from second non-winding leg 228 a sufficient distance to receive one or more segments of input winding 204, first output winding 206, and second output winding 208 therebetween.

Further, first non-winding leg 226 and second non-winding leg 228 are spaced apart from one another, and the magnetic core 202 defines an opening 238 between the first non-winding leg 226 and the second non-winding leg 228. Opening 238 is sized to receive input winding 204. In other words, integrated magnetic assembly 200 includes "split" non-winding legs between which input winding 204 is received. As described in more detail herein, the configuration of first non-winding leg 226, second non-winding leg 228, and input winding 204 facilitates a more compact magnetic assembly as compared to known magnetic assemblies, and minimizes power losses associated magnetic flux interference between different components integrated on a single magnetic core.

In the example embodiment, opening 238 is defined by first non-winding leg 226, second non-winding leg 228, first plate 222, and second plate 224. Opening 238 is sized to receive at least input winding 204, although in other suitable embodiments, opening 238 may be defined by a component other than first non-winding leg 226, second non-winding leg 228, first plate 222, and second plate 224.

In the example embodiment, magnetic core 202 also includes a plurality of spacers configured to provide gaps in magnetic core 202, and thereby provide magnetic core 202 with a desired inductance and/or saturation current. More specifically, magnetic core 202 includes a first spacer 240 disposed between first winding leg 230 and second plate 224, and a second spacer 242 disposed between second winding leg 232 and second plate 224. First spacer 240 is configured to provide a gap 244 between a first winding leg 230 and second plate 224, and second spacer 242 is configured to provide a gap 246 between second winding leg 232 and second plate 224.

In the example embodiment, first spacer 240 and second spacer 242 are constructed from a material having a relatively high magnetic permeability, such as ferrite. In alternative embodiments, first spacer 240 and/or second spacer 242 may include a material with a relatively low magnetic permeability, or a material with a relatively high magnetic reluctance. By providing first spacer 240 and second spacer 242 with desired magnetic permeabilities and/or reluctances, the inductance of integrated magnetic assembly 200 can be adjusted to a desired level. Additionally, by varying the magnetic permeability across first gap 244 and second gap 246 (for example, by partially filling first and second gap 244 and 246 with a material having a relatively high magnetic reluctance), the amount of fringing-flux produced within integrated magnetic assembly 200 during operation can be reduced, thereby improving the efficiency and the effectiveness of integrated magnetic assembly 200.

Magnetic core 202 may be constructed from any suitable material that enables integrated magnetic assembly 200 to function as described herein, including ferrite, ferrite polymer composites, powdered iron, sendust, laminated cores, tape wound cores, silicon steel, nickel-iron alloys (e.g., MuMETAL®), amorphous metals, and combinations thereof. In the example embodiment, first plate 222, first non-winding leg 226, second non-winding leg 228, first winding leg 230, and second winding leg 232 are fabricated from a single piece of magnetic material, such as ferrite. Second plate 224 is likewise fabricated from a single piece of magnetic material and coupled to first plate 222 via non-winding legs 226 and 228.

As noted above, input winding 204, first output winding 206, and second output winding 208 are each inductively coupled to magnetic core 202. More specifically, input winding 204 is wound around first winding leg 230 and second winding leg 232, first output winding 206 is wound around first winding leg 230, and second output winding 208 is wound around second winding leg 232.

Input winding 204, first output winding 206, and second output winding 208 may be constructed from any suitable conductive material that enables integrated magnetic assembly 200 to function as described herein, including, for example, copper. Input winding 204, first output winding 206, and second output winding 208 may be constructed from the same conductive material or different conductive materials. In the example embodiment, input winding 204, first output winding 206, and second output winding 208 are each constructed from copper sheets, and are assembled in an interleaved configuration such that the conductive sheets of first and second output windings 206 and 208 are interposed between the conductive sheets of input winding 204.

Input winding 204 includes a first terminal end 248 and a second terminal end 250. First terminal end 248 and second terminal end 250 are configured to be electrically coupled to an electronic circuit, such as the power converter 100 illustrated in FIG. 1.

Further, input winding 204 includes, in series from first terminal end 248 to second terminal end 250, a first terminal segment 252, a first winding segment 254, a second winding segment 256, and a second terminal segment 258. First terminal segment 252 extends from first terminal end 248 through opening 238 between first and second non-winding legs 226 and 228 to first winding segment 254. First winding segment 254 extends from first terminal segment 252, around first winding leg 230 to second winding segment 256. Second winding segment 256 extends from first winding segment 254 and around second winding leg 232 to second terminal segment 258. Second terminal segment 258 extends from second winding segment 256 through opening 238 between first and second non-winding legs 226 and 228 to second terminal end 250.

As shown in FIG. 2, first terminal segment 252 is oriented substantially parallel to second terminal segment 258. Moreover, first terminal segment 252 and second terminal segment 258 are substantially planar with one another. When current passes through input winding 204, the direction of current passing through first terminal segment 252 is substantially opposite (i.e., oriented at 180 degrees) to the direction of current passing through second terminal segment 258. The magnetic fluxes generated by first terminal segment 252 and second terminal segment 258 substantially cancel one another out, thus producing a net-zero magnetic flux within magnetic core 202. The configuration of first non-winding leg 226, second non-winding leg 228, and input winding 204 thereby facilitates a more compact integrated magnetic assembly as compared to known magnetic assemblies, and minimizes power losses associated with magnetic flux interference between different components integrated on a single magnetic core.

Figure 6:
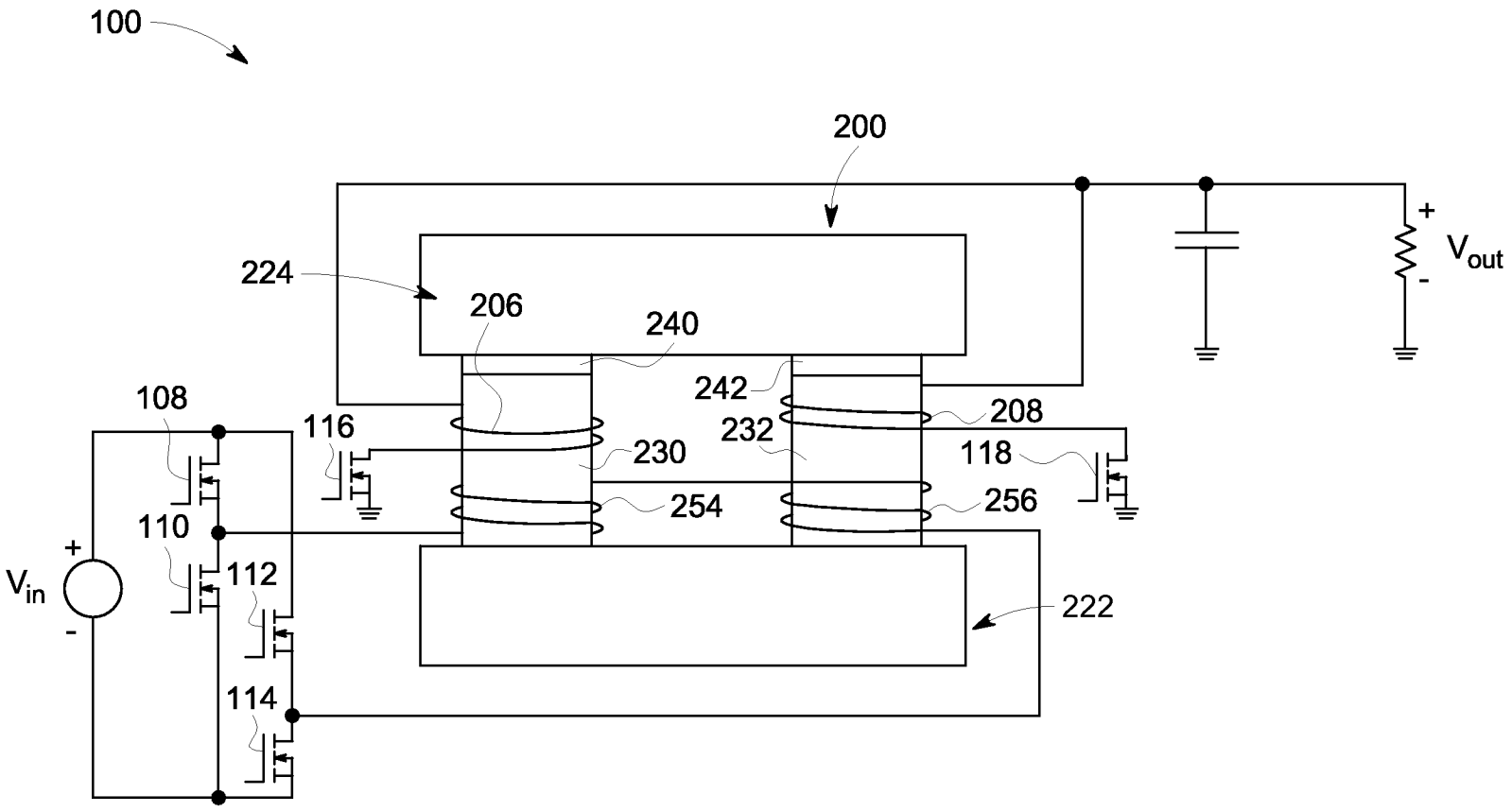
FIG. 6 is schematic view of the power converter of FIG. 1, illustrating the orientation of windings of the integrated magnetic assembly of FIG. 2.

FIG. 6 is schematic view of power converter 100 (FIG. 1), illustrating the orientation of input winding 204, first output winding 206, and second output winding 208. Multiple orientations of input winding 204, first output winding 206, and second output winding 208 with respect to one another and with respect to magnetic core 202 are possible. In the example embodiment, input winding 204, first output winding 206, and second output winding 208 are wound around first and second winding legs 230 and 232 such that multiple transformers and inductors are formed within integrated magnetic assembly 200. Specifically, first winding segment 254 of input winding 204 is wound around first winding leg 230 in a first orientation, and second winding segment 256 of input winding 204 is wound around second winding leg 232 in a second orientation having a substantially opposite polarity to the first orientation. First output winding 206 is wound around first winding leg 230 in a third orientation having a substantially opposite polarity to one of the first or second orientations, and second output winding 208 is wound around second winding leg 232 in a fourth orientation having a substantially opposite polarity to the third orientation. In one suitable alternative embodiment, first winding segment 254 of input winding 204 is wound around first winding leg 230 in a first orientation, and second winding segment 256 of input winding 204 is wound around second winding leg 232 in a second orientation having substantially the same polarity as the first orientation. First and second winding segments 254 and 256 having winding orientations with substantially the same polarity facilitates reducing the overall length of input winding 204, thereby reducing the direct current resistance (DCR) of input winding 204 and associated power losses.

As shown in FIG. 6, in the example embodiment, second winding segment 256 includes two turns around first winding leg 230, and second winding segment 256 includes two turns around second winding leg 232. First output winding 206 includes at least one turn around first winding leg 230, and second output winding 208 includes at least one turn around second winding leg 232. Each of the two transformers formed in the exemplary embodiment (shown in FIG. 1) have a turns ratio of two-to-one.

Figure 7:
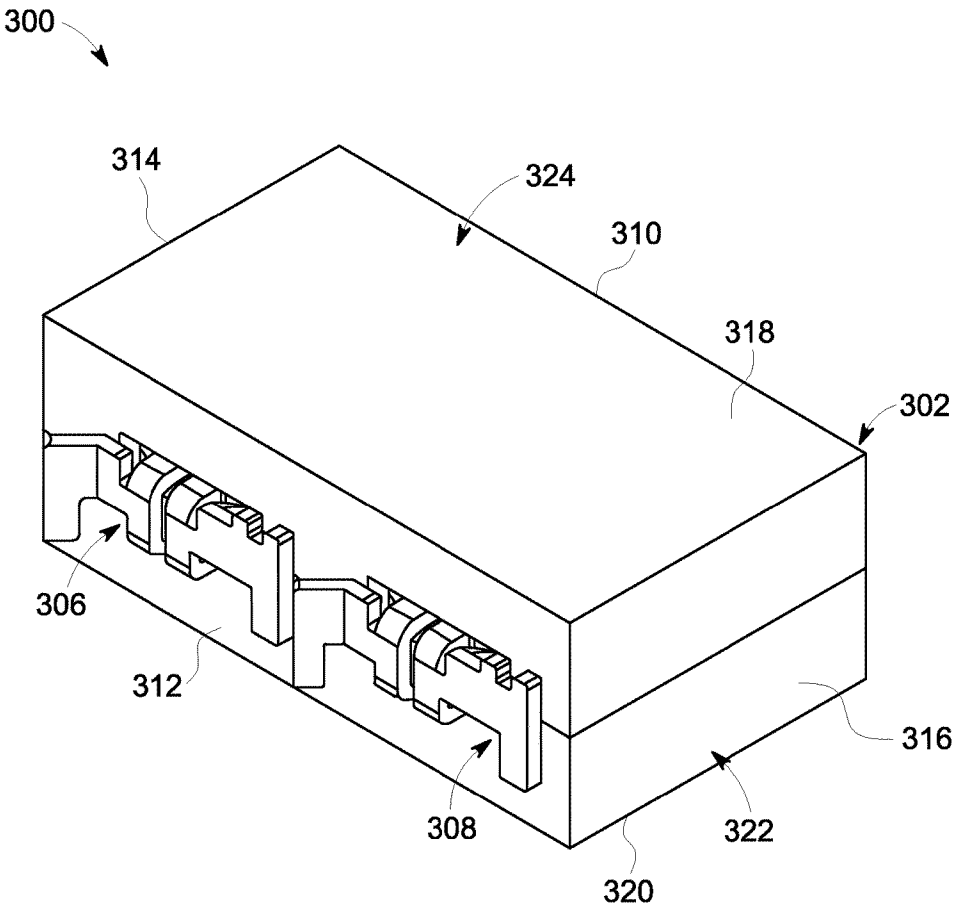
FIG. 7 is a perspective view of a first alternative embodiment of an integrated magnetic assembly suitable for use in the power converter shown in FIG. 1.
Figure 8:
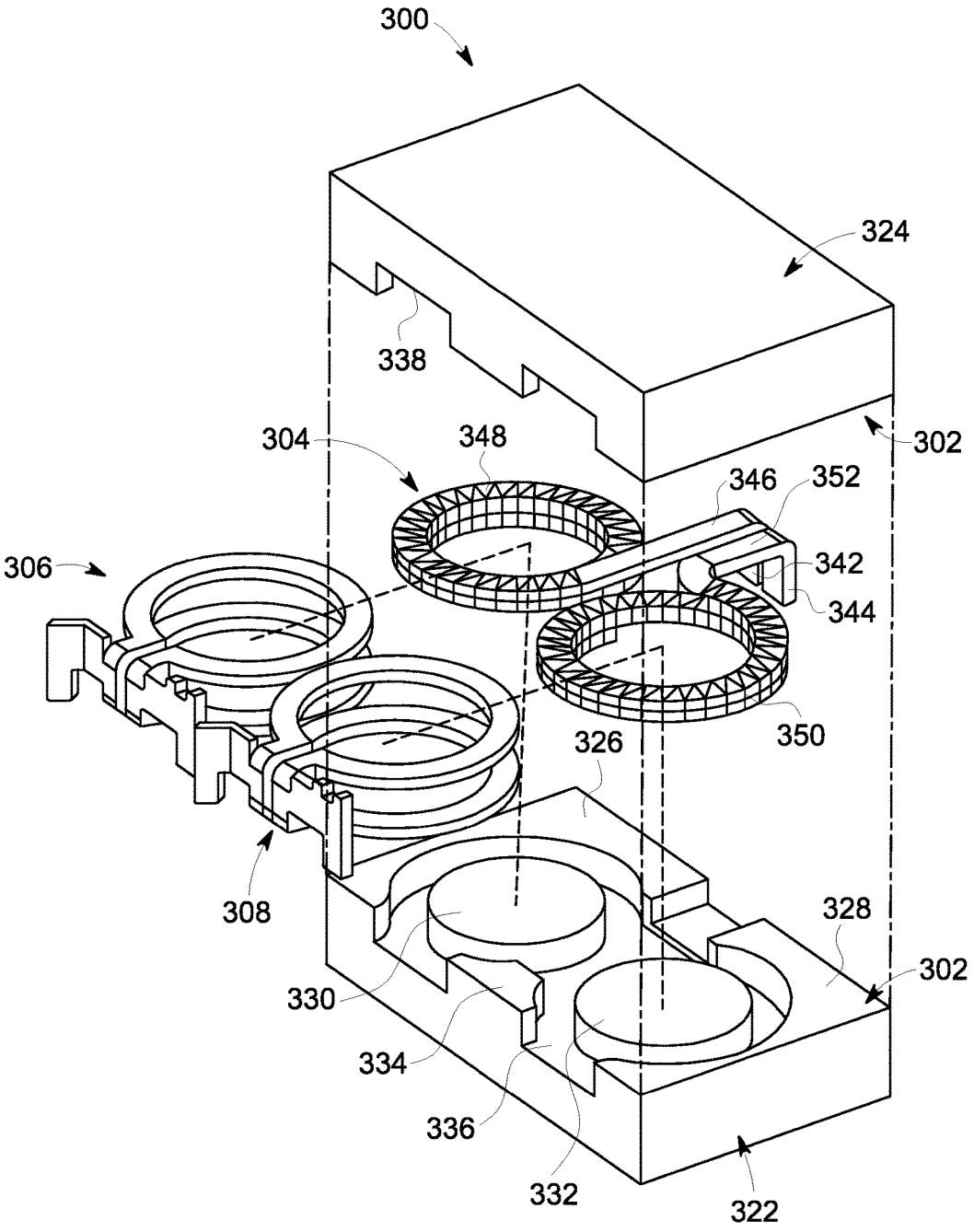
FIG. 8 is an exploded view of the integrated magnetic assembly shown in FIG. 7.

FIG. 7 is a perspective view of a first alternative embodiment of an integrated magnetic assembly 300 suitable for use in power converter 100 (FIG. 1), and FIG. 8 is an exploded view of integrated magnetic assembly 300.

As shown in FIGS. 7-8, integrated magnetic assembly 300 includes a magnetic core 302, an input winding 304, a first output winding 306, and a second output winding 308. Input winding 304, first output winding 306, and second output winding 308 are inductively coupled to magnetic core 302 such that multiple transformers and inductors are formed within integrated magnetic assembly 300.

Magnetic core 302 has a generally rectangular shape including six sides. The six sides of magnetic core 302 include a first side 310, an opposing second side 312, first and second opposing ends 314 and 316 extending between first side 310 and second side 312, and a top 318 and an opposing bottom 320 extending between first side 310 and second side 312 and between first end 314 and second end 314.

Magnetic core 302 includes a first plate 322, a second plate 324, first and second non-winding legs 326 and 328 extending between first plate 322 and second plate 324, and first and second winding legs 330 and 332 extending between first plate 322 and second plate 324. Additionally, magnetic core 302 includes a third non-winding leg 334 extending between first plate 322 and second plate 324, and disposed between first and second non-winding legs 326 and 328.

First plate 322 is coupled to second plate 324 via first non-winding leg 326, second non-winding leg 328, third non-winding leg 334, first winding leg 330, and second winding leg 332. First plate 322 and second plate 324 each include a respective interior surface 336 and 338 between which winding legs 330 and 332 and non-winding legs 326, 328, and 334 extend. When integrated magnetic assembly 300 is assembled (shown in FIG. 7), interior surfaces 336 and 338 are in facing relationship with one another.

In the embodiment illustrated in FIGS. 7-8, each non-winding leg 326, 328, and 334 and each winding leg 330 and 332 includes a lower portion extending upwards from first plate 322 towards second plate 324, and an upper portion extending downwards from second plate 324 towards first plate 322. In other suitable embodiments, one or more of 326, 328, and 334 and winding legs 330 and 332 include a single portion extending from one of first plate 322 or second plate 324 to the other of first plate 322 or second plate 324 (such as non-winding legs 226 and 228 shown in FIGS. 2-6).

First winding leg 330 and second winding leg 332 are spaced apart from one another a sufficient distance to receive one or more segments of input winding 304, first output winding 306, and second output winding 308 therebetween. Further, first winding leg 330 is spaced apart from first non-winding leg 326 and third non-winding leg 334 a sufficient distance to receive one or more segments of input winding 304, first output winding 306, and second output winding 308 therebetween. Second winding leg 332 is spaced apart from second non-winding leg 328 and third non-winding leg 334 a sufficient distance to receive one or more segments of input winding 304, first output winding 306, and second output winding 308 therebetween.

Figure 9:
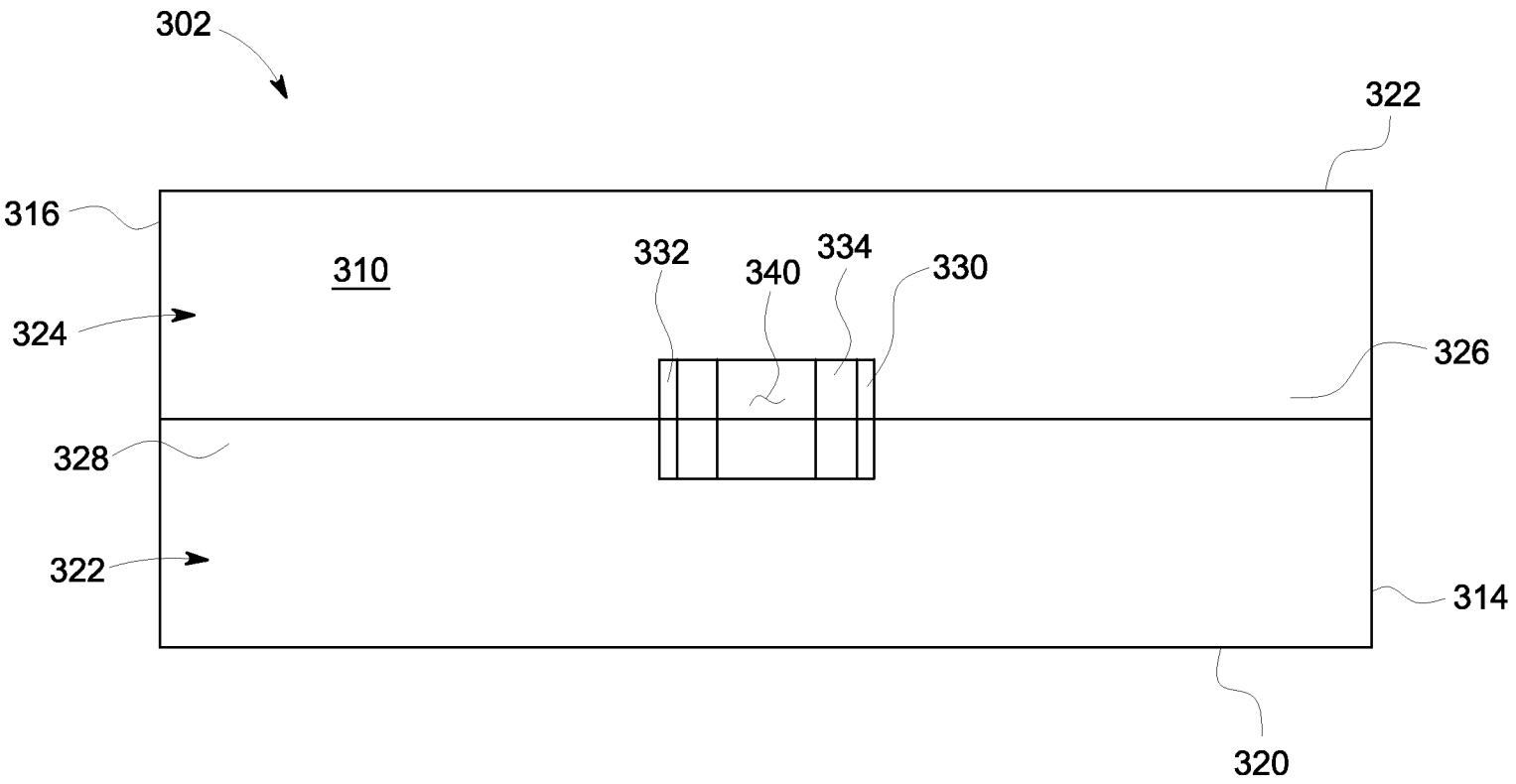
FIG. 9 is a side view of the magnetic core of the integrated magnetic assembly shown in FIG. 7.

FIG. 9 is a side view of magnetic core 302 from first side 310 of magnetic core 302. As shown in FIG. 9, first non-winding leg 326 and second non-winding leg 328 are spaced apart from one another, and magnetic core 302 defines an opening 340 between first non-winding leg 326 and second non-winding leg 328. Opening 340 is sized to receive input winding 304. In the embodiment illustrated in FIGS. 7-9, opening 340 is defined by first non-winding leg 326, second non-winding leg 328, first plate 322, and second plate 324. Opening 340 is sized to receive at least input winding 304, although in other suitable embodiments, opening 340 may be defined by a component other than first non-winding leg 326, second non-winding leg 328, first plate 322, and second plate 324.

Moreover, first non-winding leg 326 extends from first side 310 of magnetic core 302, around first winding leg 330 to second side 312 of magnetic core 302. Similarly, second non-winding leg 328 extends from first side 310 of magnetic core 302, around second winding leg 332 to second side 312 of magnetic core 302. Third non-winding leg 334 is positioned adjacent second side 312 of magnetic core 302, and between first non-winding leg 326 and second non-winding leg 328.

Together, first non-winding leg 326, second non-winding leg 328, and third non-winding leg 334 substantially surround first winding leg 330 and second winding leg 332, thereby enclosing first winding leg 330 and second winding leg 332 within magnetic core 302. The configuration of magnetic core 302 provides a reduced average magnetic flux path through magnetic core 302 as compared to magnetic core 202 (shown in FIGS. 2-6). Further, in operation, a higher percentage of magnetic core 302 is utilized by magnetic flux as compared to magnetic core 202 (shown in FIGS. 2-6). As a result, the size of magnetic core 302 (and thus, integrated magnetic assembly 300) can be reduced as compared to magnetic core 202, without adversely affecting the operational characteristics of integrated magnetic assembly 300.

Magnetic core 302 may be constructed the same materials and in the same manner as magnetic core 202 described above.

Input winding 304, first output winding 306, and second output winding 308 are each inductively coupled to magnetic core 302. More specifically, input winding 304 is wound around first winding leg 330 and second winding leg 332, first output winding 306 is wound around first winding leg 330, and second output winding 308 is wound around second winding leg 332.

Input winding 304 includes a first terminal end 342 and a second terminal end 344. First terminal end 342 and second terminal end 344 are configured to be electrically coupled to an electronic circuit, such as the power converter 100 illustrated in FIG. 1.

Further, input winding 304 includes, in series from first terminal end 342 to second terminal end 344, a first terminal segment 346, a first winding segment 348, a second winding segment 350, and a second terminal segment 352. First terminal segment 346 extends from first terminal end 342 through opening 340 between first and second non-winding legs 326 and 328 to first winding segment 348. First winding segment 348 extends from first terminal segment 346, around first winding leg 330 to second winding segment 350. Second winding segment 350 extends from first winding segment 348 and around second winding leg 332 to second terminal segment 352. Second terminal segment 352 extends from second winding segment 350 through opening 340 between first and second non-winding legs 326 and 328 to second terminal end 344.

Similar to input winding 304 (shown in FIG. 2), first terminal segment 346 is oriented substantially parallel to second terminal segment 352, and first and second terminal segments 346 and 352 are substantially planar with one another.

As shown in FIG. 8, input winding 304, first output winding 306, and second output winding 308 are non-planar windings. As used herein, the term "non-planar winding" refers to a winding having a width-to-thickness ratio of at least about 0.25. In the illustrated embodiment, input winding 304, first output winding 306, and second output winding 308 each have a generally rectangular cross-section. In other suitable embodiments, one or more of input winding 304, first output winding 306, and second output winding 308 may have a circular cross-section, an elliptical cross-section, a rounded cross-section, or any suitable combination thereof.

Input winding 304, first output winding 306, and second output winding 308 each have a reduced width as compared to input winding 204, first output winding 206, and second output winding 208 (all shown in FIG. 2). The reduced width of input winding 304, first output winding 306, and second output winding 308 enable first and second winding legs 330 and 332 to be positioned closer to one another as compared to first and second winding legs 230 and 232 (shown in FIG. 2), thereby facilitating a more compact construction of integrated magnetic assembly 300.

Input winding 304, first output winding 306, and second output winding 308 may be wound around first and second winding legs 330 and 332 in substantially the same manner as input winding 204, first output winding 206, and second output winding 208 described above with reference to FIG. 6.

Figure 10:
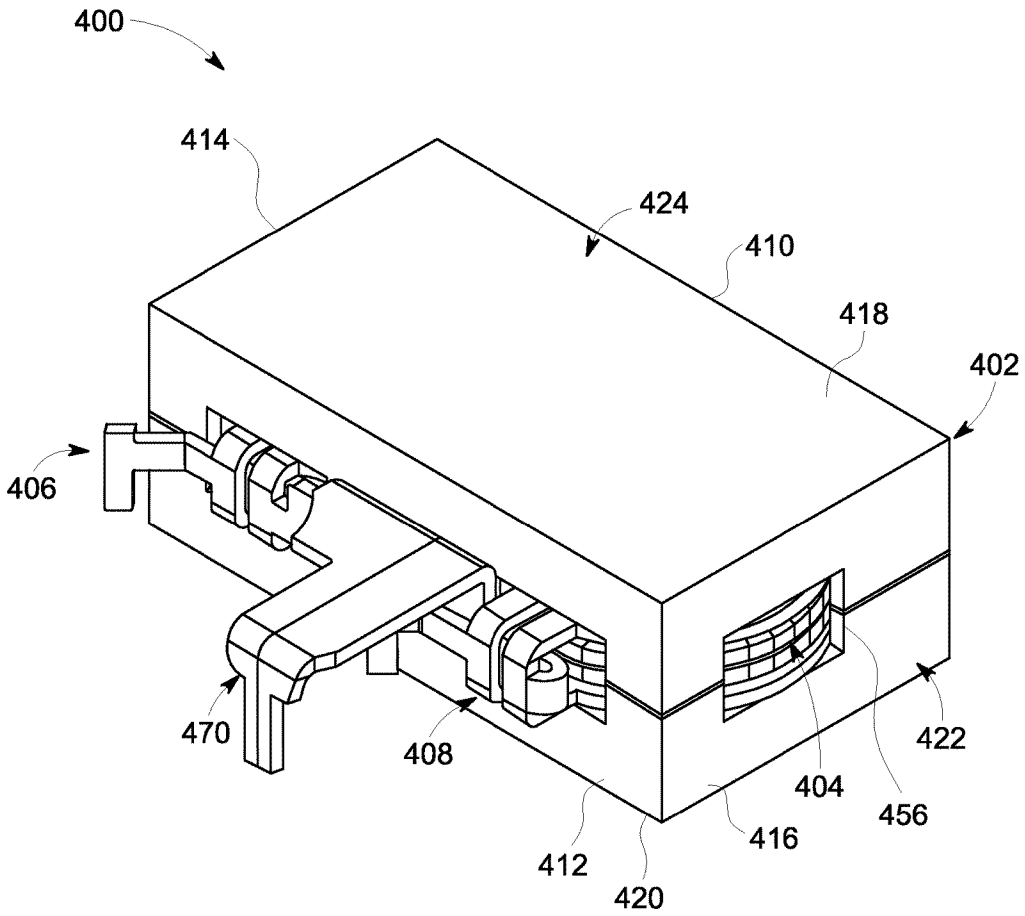
FIG. 10 is a perspective view of a second alternative embodiment of an integrated magnetic assembly suitable for use in the power converter shown in FIG. 1.
Figure 11:
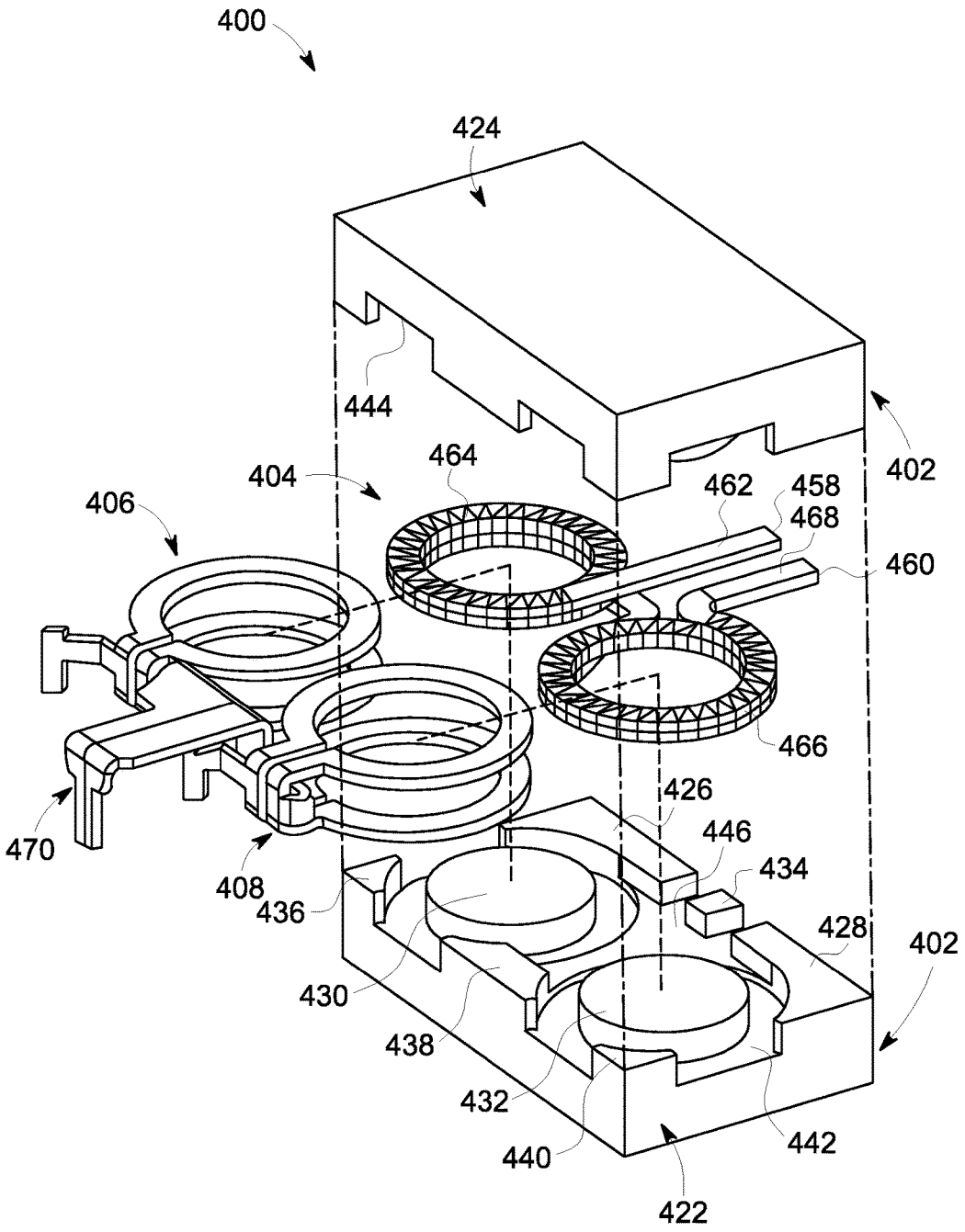
FIG. 11 is an exploded view of the integrated magnetic assembly shown in FIG. 10.

FIG. 10 is a perspective view of a second alternative embodiment of an integrated magnetic assembly 400 suitable for use in power converter 100 (FIG. 1), and FIG. 11 is an exploded view of integrated magnetic assembly 400.

As shown in FIGS. 10-11, integrated magnetic assembly 400 includes a magnetic core 402, an input winding 404, a first output winding 406, and a second output winding 408. Input winding 404, first output winding 406, and second output winding 408 are inductively coupled to magnetic core 402 such that multiple transformers and inductors are formed within integrated magnetic assembly 400.

Magnetic core 402 has a generally rectangular shape including six sides. The six sides of magnetic core 402 include a first side 410, an opposing second side 412, first and second opposing ends 414 and 416 extending between first side 410 and second side 412, and a top 418 and an opposing bottom 420 extending between first side 410 and second side 412 and between first end 414 and second end 416.

Magnetic core 402 includes a first plate 422, a second plate 424, first and second non-winding legs 426 and 428 extending between first plate 422 and second plate 424, and first and second winding legs 430 and 432 extending between first plate 422 and second plate 424. Additionally, magnetic core 402 includes a third non-winding leg 434, a fourth non-winding leg 436, a fifth non-winding leg 438 and a sixth non-winding leg 440, each extending between first plate 422 and second plate 424.

First plate 422 is coupled to second plate 424 via winding legs 430 and 432 and non-winding legs 426, 428, 434, 436, 438, and 440. First plate 422 and second plate 424 each include a respective interior surface 442 and 444 between which winding legs 430 and 432 and non-winding legs 426, 428, 434, 436, 438, and 440 extend. When integrated magnetic assembly 400 is assembled (shown in FIG. 10), interior surfaces 442 and 444 are in facing relationship with one another.

Further, first plate 422 includes a raised portion 446 extending outward from interior surface 442 towards second plate 424. Raised portion 446 extends from first side 410 of magnetic core 402 towards second side 412 and between first and second winding legs 430 and 432. Second plate 424 also includes a raised portion (now shown) substantially identical to raised portion 446.

In the embodiment illustrated in FIGS. 10-11, each non-winding leg 426, 428, 434, 436, 438, and 440 and each winding leg 430 and 432 includes a lower portion extending upwards from first plate 422 towards second plate 424, and an upper portion extending downwards from second plate 424 towards first plate 422. In other suitable embodiments, one or more of non-winding legs 426, 428, 434, 436, 438, and 440 and winding legs 430 and 432 include a single portion extending from one of first plate 422 or second plate 424 to the other of first plate 422 or second plate 424 (such as non-winding legs 226 and 228 shown in FIGS. 2-6).

First winding leg 430 and second winding leg 432 are spaced apart from one another a sufficient distance to receive one or more segments of input winding 404, first output winding 406, and second output winding 408 therebetween. Further, first winding leg 430 is spaced apart from each non-winding leg 426, 428, 434, 436, 438, and 440 a sufficient distance to receive one or more segments of input winding 404, first output winding 406, and second output winding 408 therebetween. Second winding leg 432 is spaced apart from each non-winding leg 426, 428, 434, 436, 438, and 440 a sufficient distance to receive one or more segments of input winding 404, first output winding 406, and second output winding 408 therebetween.

Figure 12:
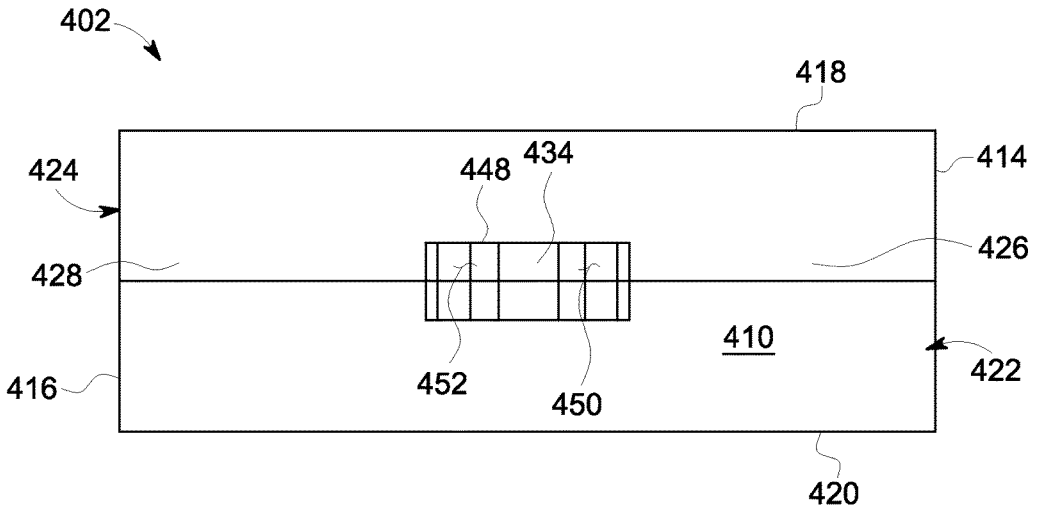
FIG. 12 is a side view of the magnetic core of the integrated magnetic assembly shown in FIG. 10.

FIG. 12 is a side view of magnetic core 402 from first side 410 of magnetic core 402. As shown in FIG. 12, first non-winding leg 426 and second non-winding leg 428 are spaced apart from one another, and magnetic core 402 defines an opening 448 between first non-winding leg 426 and second non-winding leg 428. Further, third non-winding leg 434 is disposed within opening 448 and between first non-winding leg 426 and second non-winding leg 428. Third non-winding leg 434 divides opening 448 into a first opening 450 and a second opening 452. More specifically, first opening 450 is defined by first non-winding leg 426, third non-winding leg 434, first plate 422, and second plate 424. Second opening 452 is defined by second non-winding leg 428, third non-winding leg 434, first plate 422 and second plate 424. First opening 450 and second opening 452 are each sized to receive a portion of input winding 404.

Fourth non-winding leg 436, fifth non-winding leg 438, and sixth non-winding leg 440 are each positioned proximate second side 412 of magnetic core 402. Fourth non-winding leg 436 and sixth non-winding leg 440 are spaced apart from another, and fifth non-winding leg 438 is disposed between fourth non-winding leg 436 and sixth non-winding leg 440.

Together, non-winding legs 426, 428, 434, 436, 438, and 440 substantially surround first winding leg 430 and second winding leg 432, thereby enclosing first and second winding legs 430 and 432 within magnetic core 402.

Figure 13:
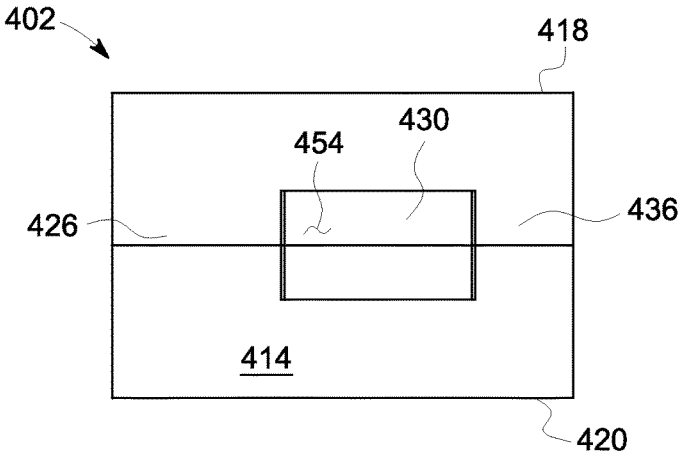
FIG. 13 is an end view of the magnetic core of the integrated magnetic assembly shown in FIG. 10.
Figure 14:
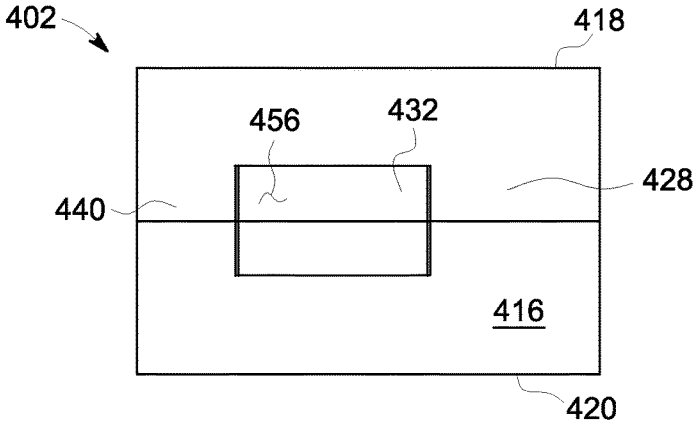
FIG. 14 is another end view of the magnetic core of the integrated magnetic assembly shown in FIG. 10.

FIG. 13 is an end view of magnetic core 402 from first end 414 of magnetic core 402, and FIG. 14 is an end view of magnetic core 402 from second end 416 of magnetic core 402. As shown in FIGS. 13 and 14, magnetic core 402 further includes a first ventilation opening 454 in first end 414, and a second ventilation opening 456 in second end 416. In the illustrated embodiment, first ventilation opening 454 is defined by first non-winding leg 426, fourth non-winding leg 436, first plate 422, and second plate 424. Second ventilation opening 456 is defined by second non-winding leg 428, sixth non-winding leg 440, first plate 422, and second plate 424. Ventilation openings 454 and 456 facilitate airflow through magnetic core 402, and thereby facilitate conduction of heat away from the interior of integrated magnetic assembly 400.

Magnetic core 402 may be constructed the same materials and in the same manner as magnetic core 402 described above.

Input winding 404, first output winding 406, and second output winding 408 are each inductively coupled to magnetic core 402. More specifically, input winding 404 is wound around first winding leg 430 and second winding leg 432, first output winding 406 is wound around first winding leg 430, and second output winding 408 is wound around second winding leg 432.

Input winding 404 includes a first terminal end 458 and a second terminal end 460. First terminal end 458 and second terminal end 460 are configured to be electrically coupled to an electronic circuit, such as the power converter 100 illustrated in FIG. 1.

Further, input winding 404 includes, in series from first terminal end 458 to second terminal end 460, a first terminal segment 462, a first winding segment 464, a second winding segment 466, and a second terminal segment 468. First terminal segment 462 extends from first terminal end 458 through first opening 450 between first and third non-winding legs 426 and 434 to first winding segment 464. First winding segment 464 extends from first terminal segment 462, around first winding leg 430 to second winding segment 466. Second winding segment 466 extends from first winding segment 464 and around second winding leg 432 to second terminal segment 468. Second terminal segment 468 extends from second winding segment 466 through second opening 452 between second and third non-winding legs 428 and 434 to second terminal end 460.

Similar to input winding 204 (shown in FIG. 2), first terminal segment 462 is oriented substantially parallel to second terminal segment 468, and first and second terminal segments 462 and 468 are substantially planar with one another.

In the embodiment illustrated in FIGS. 10-14, first output winding 406 and second output winding 408 are formed from a single, unitary stamped winding that includes an integrated output pin 470. First output winding 406 and second output winding 408 are electrically coupled to one another via integrated output pin 470. By integrating the connection between first output winding 406 and second output winding 408 using integrated output pin 470, the number of solder connections needed to electrically couple integrated magnetic assembly 400 to an electronic circuit (e.g. on a printed circuit board (PCB)) can be reduced as compared to magnetic assemblies having output windings electrically coupled to one another via PCB interconnects. The configuration of first output winding 406, second output winding 408, and integrated output pin 470 therefore facilitates reducing power losses associated with solder connections.

Input winding 404, first output winding 406, and second output winding 408 may be wound around first and second winding legs 430 and 432 in substantially the same manner as input winding 404, first output winding 406, and second output winding 408 described above with reference to FIG. 6.

Figure 15:
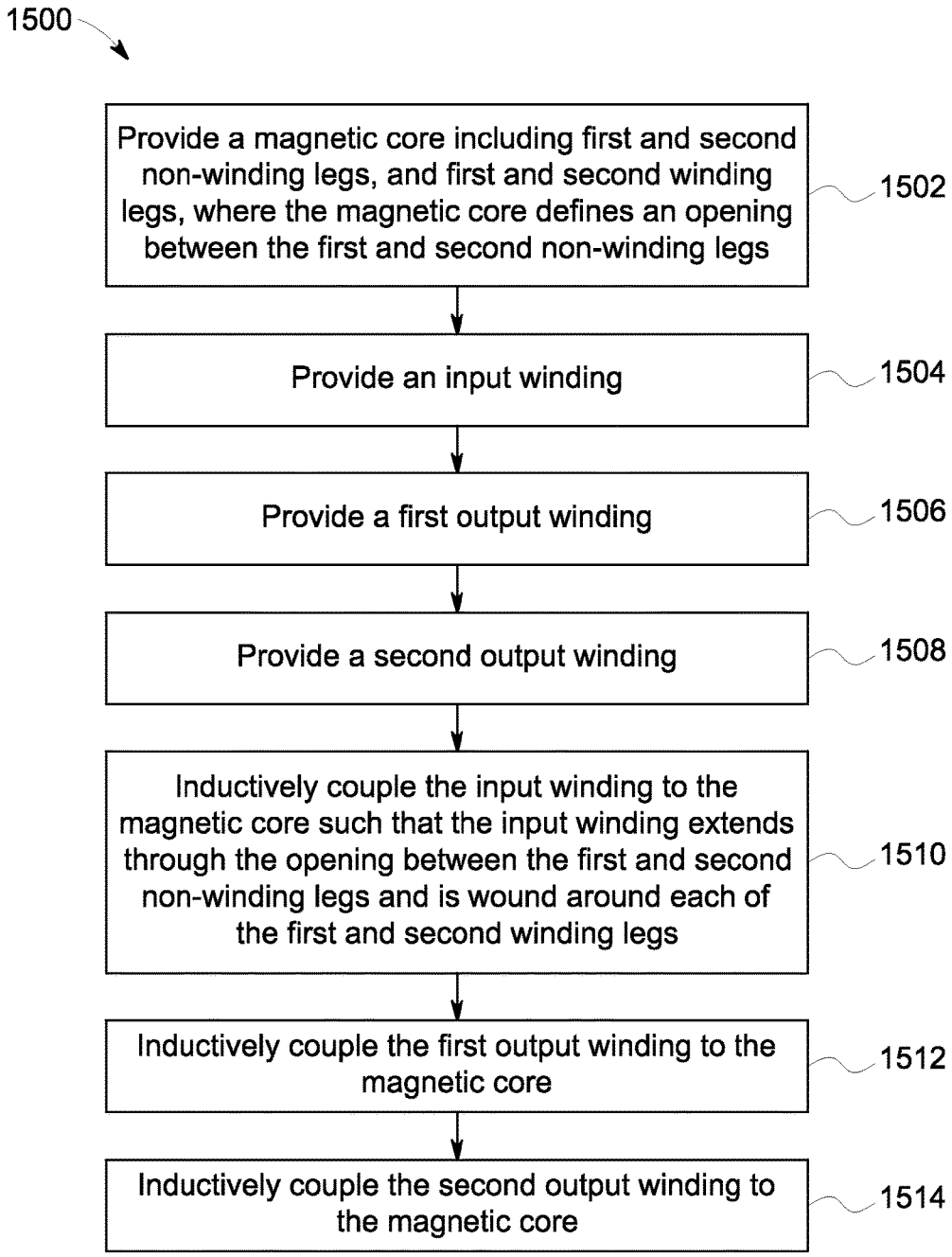
FIG. 15 is a flowchart of an example method of assembling an integrated magnetic assembly.

FIG. 15 is a flowchart of an example method 1500 of assembling an integrated magnetic assembly, such as the integrated magnetic assembly 200 shown in FIG. 2. A magnetic core, such as magnetic core 202, is provided 1502. The magnetic core includes first and second non-winding legs, and first and second winding legs. The first and second non-winding legs are spaced apart from one another, and the magnetic core defines an opening between the first and second non-winding legs. An input winding, such as input winding 204, is provided 1504. A first output winding, such as first output winding 206, is provided 1506. A second output winding, such as second output winding 208, is provided 1508. The input winding is inductively coupled 1510 to the magnetic core such that the input winding extends through the opening between the first and second non-winding legs and is wound around each of the first and second winding legs. The first output winding is inductively coupled 1512 to the magnetic core such that the first output winding is wound around the first winding leg. The second output winding is inductively coupled 1514 to the magnetic core such that the second output winding is wound around the second winding leg.

Example embodiments of integrated magnetic assemblies are described herein. An integrated magnetic assembly includes a magnetic core, an input winding inductively coupled to the magnetic core, a first output winding inductively coupled to the magnetic core, and a second output winding inductively coupled to the magnetic core. The magnetic core includes first and second non-winding legs, and first and second winding legs. The first and second non-winding legs are spaced apart from one another, and the magnetic core defines an opening between the first and second non-winding legs. The input winding extends through the opening between the first and second non-winding legs, and is wound around each of the first and second winding legs. The first output winding is wound around the first winding leg. The second output winding is wound around the second winding leg.

As compared to at least some integrated magnetic assemblies, in the systems and methods described herein, an integrated magnetic core utilizes split legs for both the winding and non-winding legs, and a primary winding extending through the core between the non-winding legs. Using split legs for the winding and non-winding legs and passing the primary winding through the core between the non-winding legs reduces the size of the integrated magnetic assembly, thereby increasing the power density, while minimizing the net magnetic flux on the integrated magnetic core.

The order of execution or performance of the operations in the embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An integrated magnetic assembly comprising:

a magnetic core comprising:

first and second non-winding legs, said first and second non-winding legs spaced apart from one another, said magnetic core defining a first opening between said first and second non-winding legs;

first and second winding legs, said first and second winding legs spaced apart from one another and defining a second opening between said first and second winding legs;

a first plate and a second plate positioned opposite said first plate, said first plate coupled to said second plate by at least said first and second non-winding legs; and at least one of:

a first spacer extending from said first winding leg to said second plate to provide a first gap between said first winding leg and said second plate; and a second spacer extending from said second winding leg to said second plate to provide a second gap between said second winding leg and said second plate;

an input winding inductively coupled to said magnetic core and comprising a first terminal segment, said first terminal segment of said input winding extending through the first opening between said first and second non-winding legs, such that said first terminal segment of said input winding extends from a first side of said first and second non-winding legs through the first opening to a second side of said first and second non-winding legs, said second side opposite said first side, said input winding further extending through the second opening between said first and second winding legs, said input winding wound separately around each of said first winding leg and said second winding leg, said first and second winding legs located on the second side of said first and second non-winding legs;

a first output winding inductively coupled to said magnetic core, said first output winding wound around said first winding leg; and a second output winding inductively coupled to said magnetic core, said second output winding wound around said second winding leg.

2. An integrated magnetic assembly in accordance with claim 1, wherein said input winding further comprises a first winding segment wound around said first winding leg, a second winding segment wound around said second winding leg, and a second terminal segment extending through the first opening between said first and second non-winding legs.

3. An integrated magnetic assembly in accordance with claim 2, wherein said first terminal segment is substantially planar with and oriented substantially parallel to said second terminal segment.

4. An integrated magnetic assembly in accordance with claim 2, wherein said magnetic core further comprises a third non-winding leg disposed between said first and second non-winding legs, said first terminal segment extending between said first non-winding leg and said third non-winding leg, said second terminal segment extending between said second non-winding leg and said third non-winding leg.

5. An integrated magnetic assembly in accordance with claim 1, wherein said first output winding and said second output winding are formed from a unitary winding, said winding including an integrated output pin, wherein said first output winding and said second output winding are electrically coupled to one another by said integrated output pin.

6. An integrated magnetic assembly in accordance with claim 1, wherein each of said input winding, said first output winding, and said second output winding comprises a non-planar winding.

7. An integrated magnetic assembly in accordance with claim 1, wherein said magnetic core further comprises a first side, a second side, a first end, and a second end, said first and second ends extending between said first and second sides of said magnetic core, wherein said first side of said magnetic core includes the first opening, and wherein each of said first and second ends includes a ventilation opening defined therein.

8. An integrated magnetic assembly in accordance with claim 1, wherein said magnetic core further comprises a raised portion extending from an interior surface of one of said first and second plates towards the other of said first and second plates, said raised portion extending from a first side of said magnetic core towards an opposing second side, and between said first and second winding legs.

9. An integrated magnetic assembly in accordance with claim 1, wherein at least one of said first spacer and said second spacer is further configured to provide at least one of an inductance current and a saturation current in said magnetic core.

10. A method of assembling an integrated magnetic assembly, said method comprising:

providing a magnetic core including:

a first plate and a second plate positioned opposite the first plate;

first and second non-winding legs coupled to and between the first plate and the second plate;

first and second winding legs, wherein the first and second non-winding legs are spaced apart from one another, wherein the magnetic core defines a first opening between the first and second non-winding legs, wherein the first and second winding legs are spaced apart from one another and define a second opening between the first and second winding legs; and at least one of:

a first spacer extending from said first winding leg to said second plate to provide a first gap between said first winding leg and said second plate; and a second spacer extending from said second winding leg to said second plate to provide a second gap between said second winding leg and said second plate;

providing an input winding including a first terminal segment;

providing a first output winding;

providing a second output winding;

inductively coupling the input winding to the magnetic core such that the first terminal segment of the input winding extends through the first opening between the first and second non-winding legs, the first terminal segment of the input winding extending from a first side of the first and second non-winding legs through the first opening to a second side of the first and second non-winding legs, the second side opposite the first side, the input winding further extending through the second opening between the first and second winding legs, and separately around each of the first winding leg and the second winding leg, the first and second winding legs located on the second side of the first and second non-winding legs;

inductively coupling the first output winding to the magnetic core such that the first output winding is wound around the first winding leg; and inductively coupling the second output winding to the magnetic core such that the second output winding is wound around the second winding leg.

11. A method of assembling an integrated magnetic assembly in accordance with claim 10, wherein the input winding further includes a first winding segment, a second winding segment, and a second terminal segment, and wherein inductively coupling the input winding to the magnetic core further comprises inductively coupling the input winding to the magnetic core such that the first winding segment is wound around the first winding leg, the second winding segment is wound around the second winding leg, and the second terminal segment extends through the first opening between the first and second non-winding legs.

12. A method of assembling an integrated magnetic assembly in accordance with claim 11, wherein inductively coupling the input winding to the magnetic core further comprises inductively coupling the input winding to the magnetic core such that the first terminal segment is substantially planar with and oriented substantially parallel to the second terminal segment.

13. A method of assembling an integrated magnetic assembly in accordance with claim 11, wherein the magnetic core further includes a third non-winding leg disposed within the opening between the first non-winding leg and the second non-winding leg, and wherein inductively coupling the input winding to the magnetic core further comprises inductively coupling the input winding to the magnetic core such that the first terminal segment extends between the first non-winding leg and the third non-winding leg, and the second terminal segment extends between the second non-winding leg and the third non-winding leg.

14. A method of assembling an integrated magnetic assembly in accordance with claim 10, further comprising configuring at least one of the first spacer and the second spacer to provide at least one of an inductance current and a saturation current in the magnetic core.

15. A magnetic core for an integrated magnetic assembly, said magnetic core comprising:

a first plate;

a second plate positioned opposite said first plate;

first and second non-winding legs coupled to and between said first plate and said second plate, said first and second non-winding legs spaced apart from one another, wherein said first plate, said second plate, said first non-winding leg, and said second non-winding leg define an opening between said first and second non-winding legs configured to receive a terminal segment of an input winding such that the terminal segment extends from a first side of said first and second non-winding legs through the opening to a second side of said first and second non-winding legs, the second side opposite the first side;

first and second winding legs extending between said first plate and said second plate, said first and second winding legs spaced apart from one another and cooperatively defining a winding channel therebetween configured to receive the input winding, said first and second winding legs located on the second side of said first and second non-winding legs;

at least one of:

a first spacer extending from said first winding leg to said second plate to provide a first gap between said first winding leg and said second plate; and a second spacer extending from said second winding leg to said second plate to provide a second gap between said second winding leg and said second plate; and a third non-winding leg disposed between said first and second winding legs and extending between said first plate and said second plate.

16. A magnetic core in accordance with claim 15, wherein said first and second winding legs are at least partially enclosed within said magnetic core by said first and second non-winding legs.

17. A magnetic core in accordance with claim 15, wherein said magnetic core further comprises a first side, a second side, a first end, and a second end, said first and second ends extending between said first and second sides of said magnetic core, wherein said first side of said magnetic core includes the opening, and wherein each of said first and second ends includes a ventilation opening defined therein.

18. A magnetic core in accordance with claim 15, further comprising a fourth non-winding leg disposed within the opening between said first and second non-winding legs, said fourth non-winding leg dividing the opening into a first opening defined by said first non-winding leg, said fourth non-winding leg, said first plate, and said second plate, and a second opening defined by said second non-winding leg, said fourth non-winding leg, said first plate, and said second plate.

19. A magnetic core in accordance with claim 15, further comprising a raised portion extending from an interior surface of one of said first and second plates towards the other of said first and second plates, said raised portion extending from a first side of said magnetic core towards an opposing second side, and between said first and second winding legs.

20. A magnetic core in accordance with claim 15, wherein at least one of said first spacer and said second spacer is further configured to provide at least one of an inductance current and a saturation current in said magnetic core.

* * * * *